US009151468B2

(12) United States Patent
Xu et al.

(10) Patent No.: US 9,151,468 B2
(45) Date of Patent: Oct. 6, 2015

(54) HIGH BRIGHTNESS ILLUMINATION DEVICES USING WAVELENGTH CONVERSION MATERIALS

(75) Inventors: Li Xu, Saratoga, CA (US); Yi Zhang, Sunnyvale, CA (US)

(73) Assignee: AXLEN, INC., Wilmington, DE (US)

( * ) Notice: Subject to any disclaimer, the term of this patent is extended or adjusted under 35 U.S.C. 154(b) by 156 days.

(21) Appl. No.: 13/807,271

(22) PCT Filed: Jun. 28, 2011

(86) PCT No.: PCT/US2011/042257

§ 371 (c)(1), (2), (4) Date: Dec. 27, 2012

(87) PCT Pub. No.: WO2012/006128

PCT Pub. Date: Jan. 12, 2012

(65) Prior Publication Data

US 2013/0100635 A1 Apr. 25, 2013

Related U.S. Application Data

(60) Provisional application No. 61/398,509, filed on Jun. 28, 2010.

(51) Int. Cl.

| | |
|---|---|
| ***F21V 9/00*** | (2015.01) |
| ***F21K 99/00*** | (2010.01) |
| ***F21V 9/14*** | (2006.01) |
| ***F21V 29/70*** | (2015.01) |
| ***F21V 9/16*** | (2006.01) |
| ***F21V 29/502*** | (2015.01) |
| *F21Y 101/02* | (2006.01) |

(52) U.S. Cl.
CPC ... *F21V 9/00* (2013.01); *F21K 9/56* (2013.01); *F21V 9/14* (2013.01); *F21V 9/16* (2013.01); *F21V 29/502* (2015.01); *F21V 29/70* (2015.01); *F21Y 2101/02* (2013.01)

(58) Field of Classification Search
CPC ..... G02B 6/0008; G02B 6/001
USPC ..... 362/19; 313/46
See application file for complete search history.

(56) References Cited

U.S. PATENT DOCUMENTS 7,270,442 B2 * 9/2007 Davenport et al. ..... 362/276
8,198,804 B2 * 6/2012 Adachi ..... 313/504

(Continued)

FOREIGN PATENT DOCUMENTS

KR 10-2010-0070168 A 6/2010

OTHER PUBLICATIONS

Machine translation of KR-2010-0070168.*

(Continued)

*Primary Examiner* — Nimeshkumar Patel
*Assistant Examiner* — Jacob R Stern
(74) *Attorney, Agent, or Firm* — Perkins Coie LLP

(57) ABSTRACT

High lumen output and brightness illumination modules using an excitation light source and wavelength conversion part with multi-channel heat dissipation are disclosed. The exciting light source is a light emitting diode or a laser diode emitting in the UV and/or blue region. The luminescent material in the wavelength conversion part absorbs the excitation light and emit longer wavelength light. The enhancement approaches for brightness and polarization is disclosed.

25 Claims, 6 Drawing Sheets

(56) References Cited

U.S. PATENT DOCUMENTS

| | | | | |
|---|---|---|---|---|
| 2004/0113533 | A1* | 6/2004 | Oh | 313/112 |
| 2004/0145895 | A1* | 7/2004 | Ouderkirk et al. | 362/260 |
| 2006/0145172 | A1* | 7/2006 | Su et al. | 257/98 |
| 2006/0170332 | A1* | 8/2006 | Tamaki et al. | 313/498 |
| 2008/0111145 | A1* | 5/2008 | Lin | 257/98 |
| 2009/0095960 | A1* | 4/2009 | Murayama | 257/79 |
| 2009/0140271 | A1* | 6/2009 | Sah | 257/88 |
| 2009/0262516 | A1 | 10/2009 | Li | |
| 2009/0267093 | A1 | 10/2009 | Kamada et al. | |
| 2009/0322208 | A1 | 12/2009 | Shaikevitch et al. | |
| 2010/0133556 | A1* | 6/2010 | Li et al. | 257/88 |
| 2010/0149783 | A1 | 6/2010 | Takenaka et al. | |

OTHER PUBLICATIONS

Kim, Kapbyung, Authorized Officer, Korean Intellectual Property Office, International Search Report and Written Opinion, PCT Application No. PCT/US2011/042257, dated Feb. 9, 2012.

* cited by examiner

HIGH BRIGHTNESS ILLUMINATION DEVICES USING WAVELENGTH CONVERSION MATERIALS

PRIORITY CLAIM AND RELATED APPLICATIONS

This application is a 35 USC §371 National Stage application of, and claims priority of, International Application No. PCT/US2011/042257 filed Jun. 28, 2011, which further claims the benefit of priority to U.S. Provisional Application No. 61/398,509 entitled "HIGH BRIGHTNESS ILLUMINATION LED DEVICE USING WAVELENGTH CONVERSION MATERIALS" filed Jun. 28, 2010, the disclosure of which is incorporated by reference as part of the specification of this document.

BACKGROUND

This document relates to lighting devices and modules.

Light sources based on wavelength conversion use excitation light produced by solid-state light sources such as laser diodes (LDs) or light emitting diodes (LEDs) to optically excite wavelength conversion materials such as phosphors or quantum dots to produce high brightness light at wavelengths different from the wavelength of the excitation light.

SUMMARY

High lumen output and brightness illumination modules using an excitation light source and wavelength conversion part with multi-channel heat dissipation are disclosed. The exciting light source is a light emitting diode or a laser diode emitting in the UV and/or blue region. The luminescent material in the wavelength conversion part absorbs the excitation light and emit longer wavelength light. The enhancement approaches for brightness and polarization is disclosed.

DETAILED DESCRIPTION

In certain conventional LED devices, such as white light LED devices, excitation light impinges on a wavelength conversion material attaching to blue LED die and the wavelength conversion material absorbs the excitation light and emits light at a wavelength longer than the wavelength of the excitation light. The wavelength conversion material such as phosphors is structured to have a similar size as LED chip. The brightness of such LED device is high since the Etendue is preserved in such a design.

Some other LED devices use a "remote phosphor" design where the wavelength conversion material such as phosphors is located with some physical distance away from the LED die. Some implementations of this design demonstrated promising performance on high conversion efficiency from excitation light due to reduced back scattering of excitation light. In many LED devices based on this remote phosphor design, the wavelength conversion material is often located within the individual LED package and the phosphor area is significantly larger than the LED chip size. Therefore, the output lumen of these illumination sources is limited by the individual LED and its brightness is much lower than the LED with normal phosphors configuration where phosphors is directly deposit on LED.

The LED device designs described in this document offer illumination modules that can direct one LED or combine multiple LED output onto single phosphors or one wavelength conversion material layer and provide multiple channels heat dissipation from the phosphors/wavelength conversion layer to heat sink of the module. Therefore, the LED device designs described herein offer a practical solution for generating high power and high brightness light with desired wavelength by LED or other solid-state light sources.

The present designs of using multiple LEDs can achieve high luminous light output as well as high brightness. Such designs may be used to provide high brightness and high power illumination sources that are traditionally dominated by arc lamps such as xenon and high pressure mercury lamps.

Figure 1:
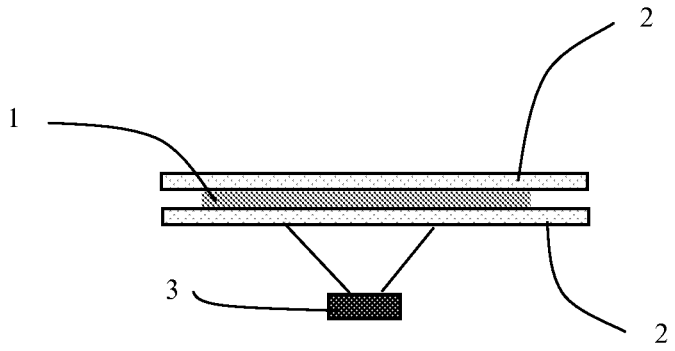
FIG. 1 is a schematic view of an exemplary illumination module.
Figure 2:
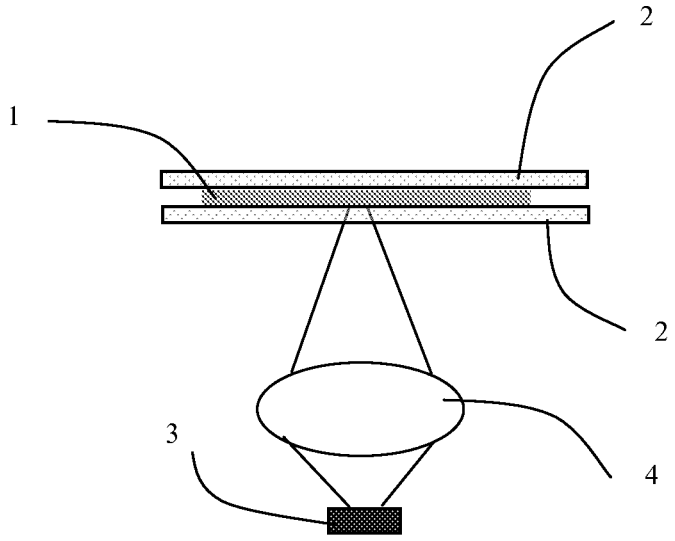
FIG. 2 is a schematic view of the illumination module with optics that delivers excitation light to luminescent layer.
Figure 3:
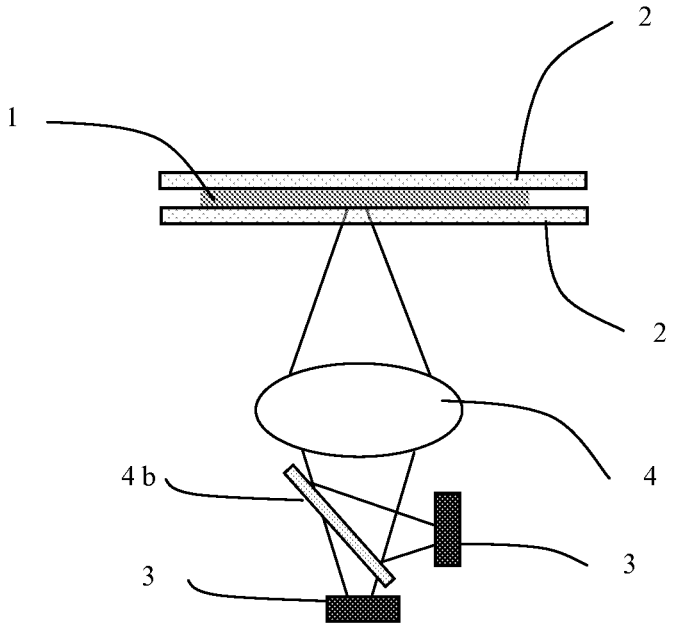
FIG. 3 is a schematic view of the illumination module with wavelength division multiplexer optics that combines outputs of two excitation light sources with different wavelengths.
Figure 4:
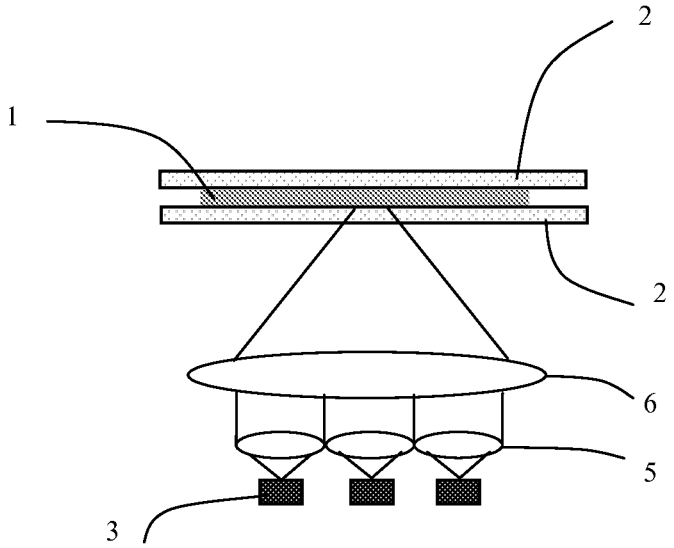
FIG. 4 is a schematic view of the illumination module with an example of delivering optics that collect multiple light sources (LEDs) and then focus it onto luminescent layer with preservation light source Etendue.

FIGS. 1-11 illustrate various features of exemplary illumination source devices described in this document. The numerals in FIGS. 1-11 represent the following elements or components of the illustrated devices:

1. Luminescent layer, e.g., phosphors with liquid or gel
2. Transparent solid plates, e.g., sapphire plates
3. Excitation light source, e.g., blue LED
4. Optics for delivering excitation light to luminescent layer; 4*b*: wavelength division multiplexer that combines excitation light from different wavelength light sources
5. Collimating optics for LED or LD
6. Condensing optics
7. Coupling optics for optical fiber
8. Optical fiber
9. Metal sheet
10. Heat-sink
11. Color filter, e.g., short-pass filter
12. Angle sensitive optics
13. Polarization selective filter In one implementation, an illumination device is described for providing high lumen output and brightness. Referring to FIG. 1, this device includes a light source 3 that provides excitation light; and a luminescent layer 1 in a liquid or gel form sandwiched by two solid plates 2 with a sufficiently high thermal conductivity (e.g., equal or greater than 15 W/m° C.). The liquid or gel of the luminescent material 1 absorbs light from excitation light source 3 at one wavelength range and emits light at second wavelength range. Both solid plates 2 are transparent to the excitation light from the light source 3 and emission light emitted by the luminescent material 1. The liquid or gel of the luminescent material 1 has a composition that is wetting with the solid plates 2.

Referring to FIGS. 6, 7, 8, 9, 10 and 11, this device can include a metal sheet 9 that is sandwiched by two transparent solid plates 2, This metal sheet 9 provides a channel of heat dissipation. The metal sheet 9 can be configured to have the same thickness as the luminescent layer 1 so that is sandwiched by the two solid plates 2 and is adjacent to the luminescent layer 1. A liquid or thermal compound can be added between the metal sheet and the two solid plates to further improve the heat dissipation. The metal sheet has larger size than the solid plates 2 and is in physical and thermal contact with a heat-sink 10.

FIGS. 7, 8, 9, 10 and 11 further show that, a heat-sink 10 can be provided outside the two plates 2 to be in thermally and physically contact with two solid plates 2 and the metal sheet 9 to improve the heat dissipation of the device. The heat-sink 10 can be configured to have an aperture for transmitting the excitation and emission light and is in physical and thermal contact to the one or both solid plates. The heat sink 10 can include metal plates or ceramic plates.

Figure 5:
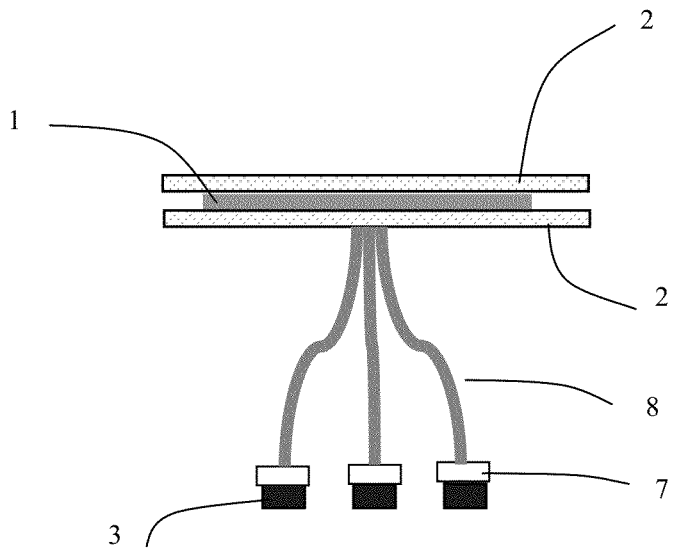
FIG. 5 is a schematic view of the illumination module with another example of delivering optics that couple multiple light sources (LEDs) into fiber and then deliver excitation light with fiber bundle onto luminescent layer with preservation light source Etendue.
Figure 6:
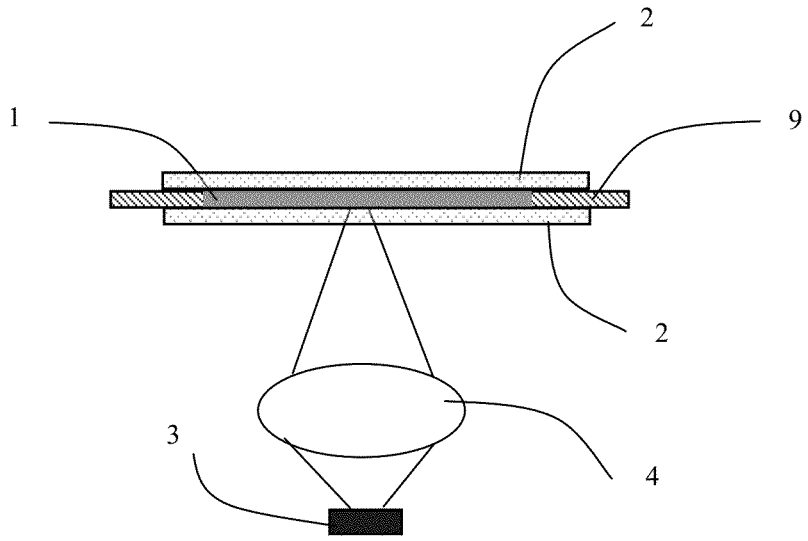
FIG. 6 is a schematic view of an illumination module with metal sheet in the embodiment of FIG. 2.
Figure 7:
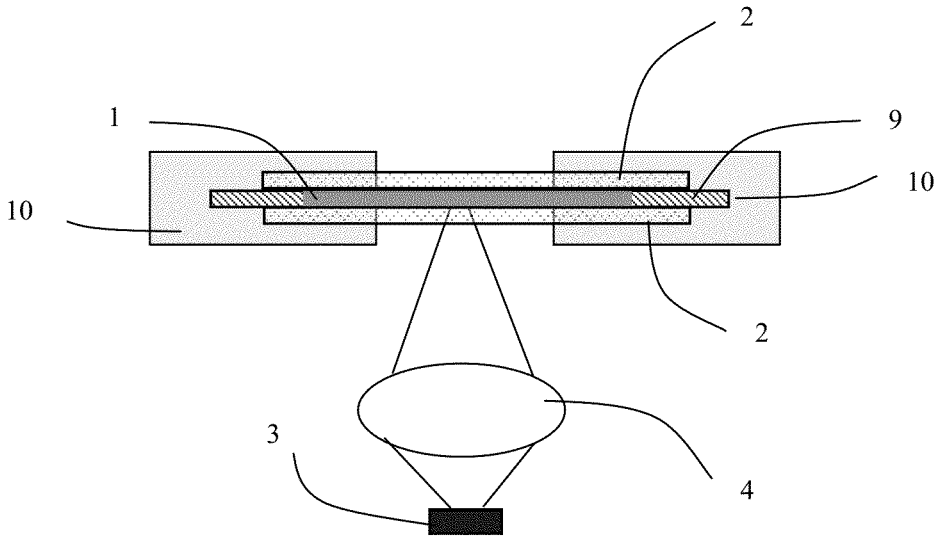
FIG. 7 is a schematic view of an illumination module with heat-sink.
Figure 8:
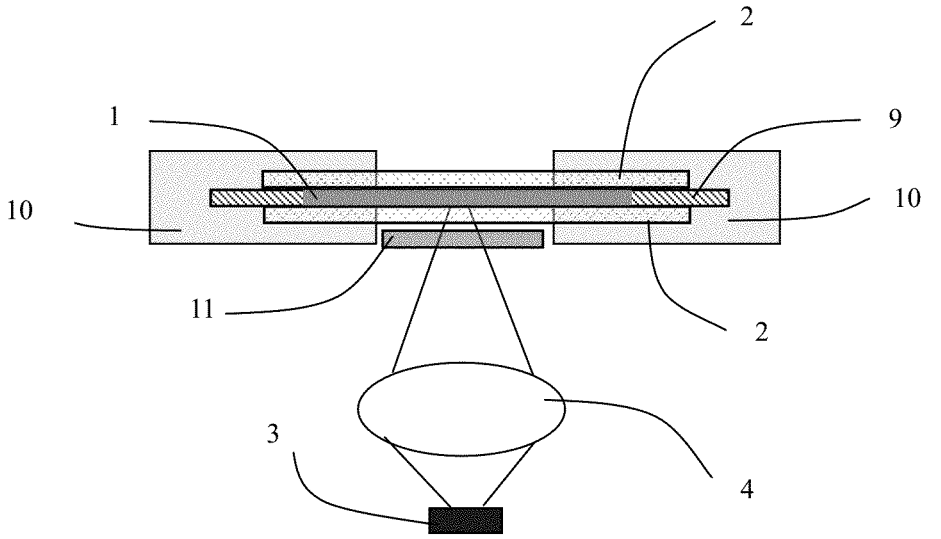
FIG. 8 is a schematic view of an illumination module with color filter transmitting excitation light and reflecting emission light from luminescent layer.

In some implementations as shown in FIG. 5, the illumination device may optionally include focusing optics 7 and optical fiber coupling optics 8 disposed between the light source 3 and the luminescent material 1.

Figure 9:
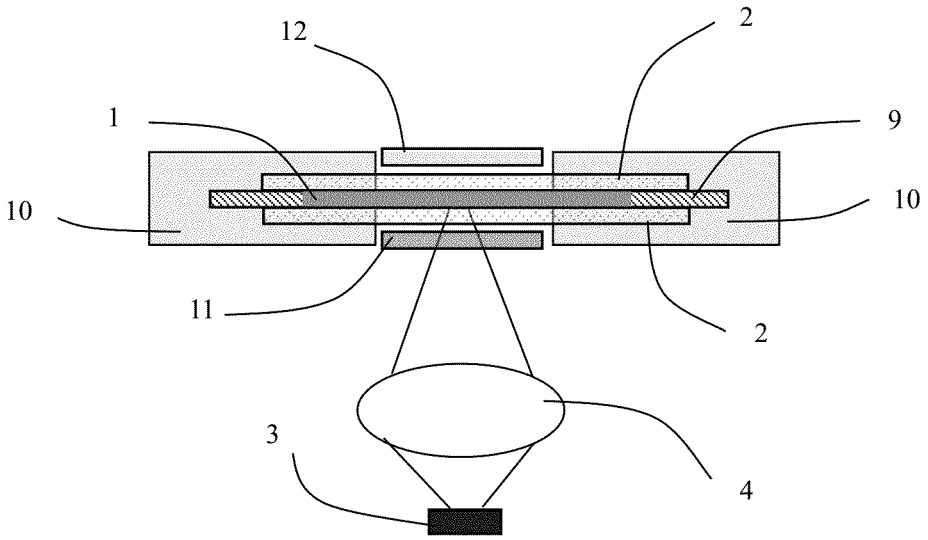
FIG. 9 is a schematic view of an illumination module with angel selective optics.

In some implementations as shown in FIG. 9, a color filter 11 can be disposed between the luminescent material 1 and the light source 3 as a short pass filter that transmits the excitation light at a shorter wavelength than that of the emission light out of the luminescent material 1. In addition, this short pass filter 11 can reflect light of longer wavelengths than that of the emission light to increase the optical efficiency and output brightness.

Figure 10:
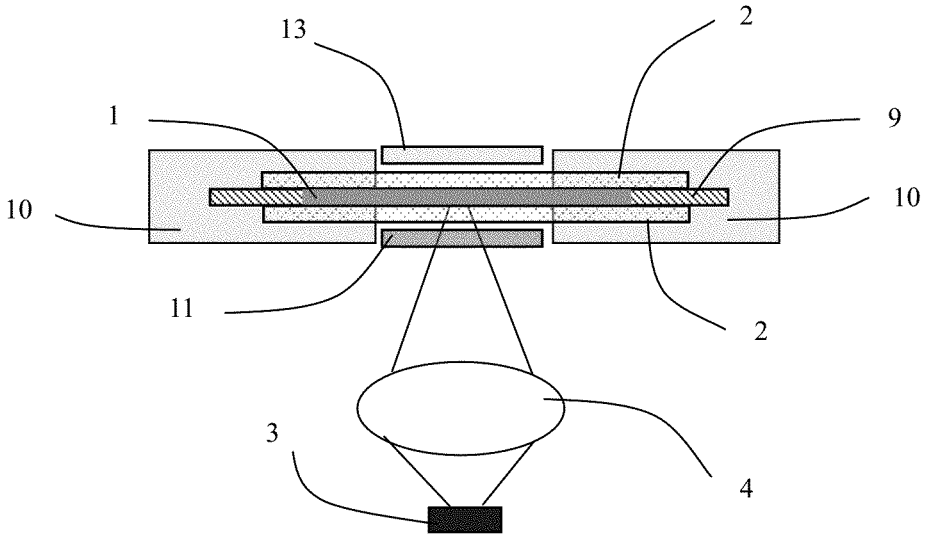
FIG. 10 is a schematic view of an illumination module with polarization selective optics.
Figure 11:
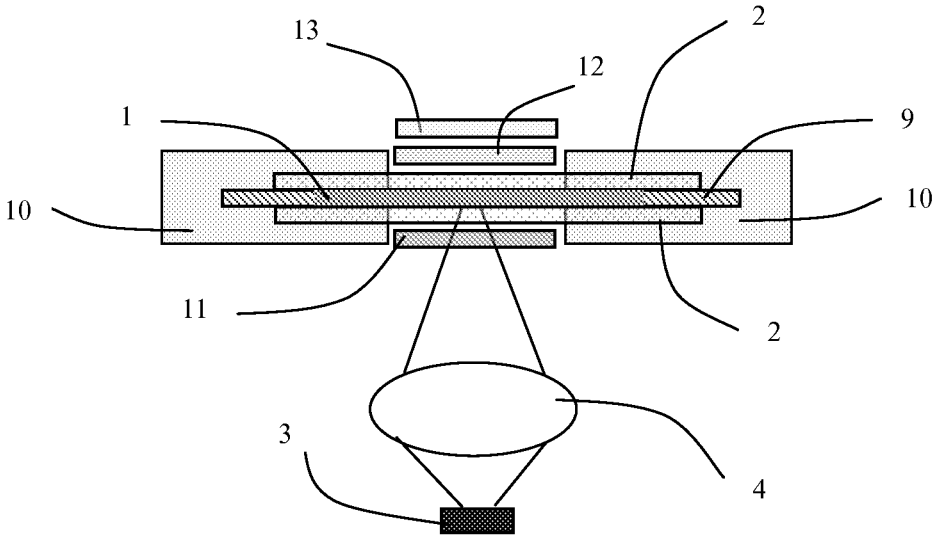
FIG. 11 is a schematic view of an illumination module with polarization selective optics.

In implementations such as in FIGS. 9, 10 and 11, an angle-selective reflecting layer or angle-sensitive optics 12 can be located adjacent the wavelength conversion material (i.e., the luminescent material 1) on a side opposite to the light source 3. This element 12 reflects light of different incident angles differently to select desired light with certain incident angles as output light. For example, the angle-selective reflecting layer or angle-sensitive optics 12 can transmit light with small incident angles while reflecting light with large incident angles. For another example, the angle selective optics transmits majority of output light with incident angle smaller than a pre-defined angle and reflects majority of output light with incident angle larger than the pre-defined angle. The angle selective optics can be implemented as a thin film filter with alternative dielectric material coating or an optical filter with defined micro-optics geometries or nano-optics structures to provide the angle sensitive properties.

In implementations shown in FIGS. 10 and 11, a reflective polarizer and/or wave-plate 13 can be disposed adjacent the wavelength conversion material 1 control optical polarization of the output light of the device.

In implementations shown in FIGS. 2, 3, 6, 7, 8, 9, 10 and 11, a wavelength division multiplexing optics 4 is provided between the light source 3 and the luminescent material 1 and combine output of excitation solid-state light sources with different excitation wavelengths into a combined beam 1.

A method for generating multicolor light and dissipating heat from luminescent material is provided. This method includes: generating an excitation light using a light source; directing the excitation light onto wavelength conversion part, the wavelength conversion part is luminescent layer sandwiched by two transparent solid plates with good thermal conductivity, wherein the luminescent material capable of absorbing the excitation light and emitting light having wavelengths different from that of the excitation light; heat that generated in luminescent material is dissipated into two transparent solid plates with good thermal contact due to the liquid or gel form of luminescent layer, a metal sheet that also sandwiched by the solid plates provides further heat dissipation channel and serve as spacer to control the thickness of luminescent layer, a heat-sink that contacts both transparent solid plates and metal sheet removes heat from wavelength conversion part.

Only a few implementations are disclosed. Enhancements and variations of the disclosed implementations and other implementations can be made based on what is described and illustrated.

What is claimed is:

1. An illumination source comprising:

an excitation light source that provides excitation light;

two solid plates spaced from each other and configured to have sufficient thermal conductivity for dissipating heat;

a luminescent layer in liquid or gel form sandwiched between the two solid plates, the luminescent layer operable to absorb the excitation light at one wavelength range and emit emission light at a second wavelength range, wherein both solid plates are transparent to the excitation light and the emission light; and a metal sheet sandwiched by the two solid plates and adjacent to the luminescent layer to provide a channel of heat dissipation; and a heat-sink in physical and thermal contact with the two solid plates and the metal sheet to provide another channel of heat dissipation.

2. An illumination source of claim 1, wherein the excitation light source is a solid-state light source.

3. An illumination source of claim 2, wherein the excitation solid-state light source includes one or multiple LEDs (light emitting diodes) or LDs (laser diodes).

4. An illumination source of claim 3, further comprising a wavelength division multiplexing optics that combines the output of excitation solid-state light sources with different excitation wavelengths.

5. An illumination source of claim 1, further comprising an optical fiber coupler and optical fiber to deliver the excitation light to the luminescent layer.

6. An illumination source of claim 3, further comprising multiple fiber couplers and a fiber bundle to combine light output from the multiple LEDs or LDs.

7. An illumination source of claim 1, further comprising focus optics located between the excitation light source and the luminescent layer.

8. An illumination source of claim 1, wherein the luminescent layer includes phosphors or quantum dots mixed in liquid or gel that is wetting with the solid plates.

9. An illumination source of claim 1, wherein the solid plates are two sapphire plates.

10. An illumination source of claim 1, wherein the solid plates are optically transparent with thermal conductivity equal or higher than 15 W/m° C.

11. An illumination source in claim 1, wherein the heat-sink has aperture for excitation and emission light .

12. An illumination source in claim 11, wherein the heat-sink includes metal plates or ceramic plates.

13. An illumination source of claim 1, wherein the metal sheet has substantially the same thickness as the luminescent layer.

14. An illumination source of claim 1, comprising a liquid or thermal compound added between the metal sheet and the two solid plates.

15. An illumination source of claim 1, wherein the metal sheet has larger size than the solid plates and is in physical and thermal contact with heat sink.

16. An illumination source of claim 1, further comprising:

a light selective filter being in an optical path of the excitation light between the excitation light source and the solid plates and configured to transmit the excitation light and reflect the emission light from luminescent layer.

17. An illumination source of claim 16, wherein there is a thin air gap (equal or less than ¼ of excitation spot size) between the light selective filter and an entrance side of the solid plates.

18. An illumination source of claim 1, further comprising an angle selective optics located adjacent to the luminescent layer and solid plate on the side that is opposite to the excitation light source, the angle selective optics transmitting majority of output light with incident angle smaller than a pre-defined angle and reflecting majority of output light with incident angle larger than the pre-defined angle.

19. An illumination source of claim 18, wherein the angle selective optics is a thin film filter with alternative dielectric material coating.

20. An illumination source of claim 18, wherein the angle selective optics is an optical filter with defined micro-optics geometries or nano-optics structures.

21. An illumination source of claim 18, wherein there is a thin air gap (equal or less than ¼ of excitation spot size) between angle selective filter and emission light exit side of the solid plates.

22. An illumination source of claim 1, further comprising a polarization selective optics located adjacent to the solid plate on the side that is opposite to the excitation light source, the polarization selective optics transmitting majority of output light with a pre-defined polarization state and reflecting other light.

23. An illumination source of claim 22, wherein the polarization selective optics is linear polarization selective filter with micro metal wire structure or nano-wire.

24. An illumination source of claim 22, further comprising a wave-plate located between the polarization selective optics and the luminescent layer.

25. The illumination device of claim 24, wherein the wave-plate is a quarter-wave wave-plate.

* * * * *